US008365420B2

(12) United States Patent
Pellenc

(10) Patent No.: US 8,365,420 B2
(45) Date of Patent: Feb. 5, 2013

(54) TIGHTENING DEVICE WITH SWIVELLING HANDLING ARM AND APPLIANCE INCLUDING SUCH A DEVICE

(75) Inventor: Roger Pellenc, Pertuis (FR)

(73) Assignee: Pellenc (Societe Anonyme), Pertuis (FR)

( * ) Notice: Subject to any disclaimer, the term of this patent is extended or adjusted under 35 U.S.C. 154(b) by 667 days.

(21) Appl. No.: 12/527,666

(22) PCT Filed: Feb. 25, 2008

(86) PCT No.: PCT/FR2008/000244
§ 371 (c)(1),
(2), (4) Date: Dec. 18, 2009

(87) PCT Pub. No.: WO2008/122716
PCT Pub. Date: Oct. 16, 2008

(65) Prior Publication Data

US 2010/0146801 A1 Jun. 17, 2010

(30) Foreign Application Priority Data

Feb. 26, 2007 (FR) ..... 07 01356

(51) Int. Cl.
*B27B 17/14* (2006.01)
*B25B 13/48* (2006.01)

(52) U.S. Cl. ..... 30/386; 81/176.2

(58) Field of Classification Search ..... 30/383, 30/386; 81/176.15, 176.2, 177.8, 177.7, 81/124.7; 280/279, 288.4, 281.1
See application file for complete search history.

(56) References Cited

U.S. PATENT DOCUMENTS

| | | | | |
|---|---|---|---|---|
| 2,693,124 | A | 11/1954 | Rozankowski | |
| 4,400,038 | A * | 8/1983 | Hosokawa | 301/124.2 |
| 5,307,713 | A | 5/1994 | White | |
| 5,383,716 | A * | 1/1995 | Stewart et al. | 301/124.2 |
| 5,396,705 | A * | 3/1995 | Leini | 30/386 |
| 5,522,143 | A * | 6/1996 | Schliemann et al. | 30/386 |
| 6,004,064 | A * | 12/1999 | Franz | 403/322.4 |
| 6,493,949 | B2 * | 12/2002 | Kondo et al. | 30/386 |
| 6,877,233 | B1 * | 4/2005 | Franke | 30/386 |
| 7,107,689 | B2 * | 9/2006 | Keeton et al. | 30/386 |
| 7,434,502 | B2 * | 10/2008 | Keeton et al. | 83/816 |
| 7,600,323 | B2 * | 10/2009 | Sugishita | 30/386 |
| 7,743,513 | B1 * | 6/2010 | Fisher et al. | 30/386 |
| 2001/0042311 | A1 * | 11/2001 | Kondo et al. | 30/386 |

FOREIGN PATENT DOCUMENTS

| | | | |
|---|---|---|---|
| DE | 29909645 | | 9/1999 |
| SU | 1329966 | A * | 8/1987 |
| WO | 2005108030 | | 11/2005 |

* cited by examiner

*Primary Examiner* — David B Thomas
(74) *Attorney, Agent, or Firm* — Egbert Law Offices, PLLC

(57) ABSTRACT

Tightening device of the screw-nut type includes a tightening member, which can be rotated, and a rotary wrench for this tightening member, equipped with a handling arm. The wrench and the tightening member are joined by a connecting device in such a way that the wrench can swivel in relation to the tightening member around a swivel axis substantially perpendicular to the screwing axis of the tightening member. Thus, it can be placed in a rest position substantially perpendicular to the screwing axis and can rotate the tightening member around the screwing axis or rotated freely in relation to the tightening member around the screwing axis, over a range of angular clearance ($\alpha$) of at least 170°.

12 Claims, 5 Drawing Sheets

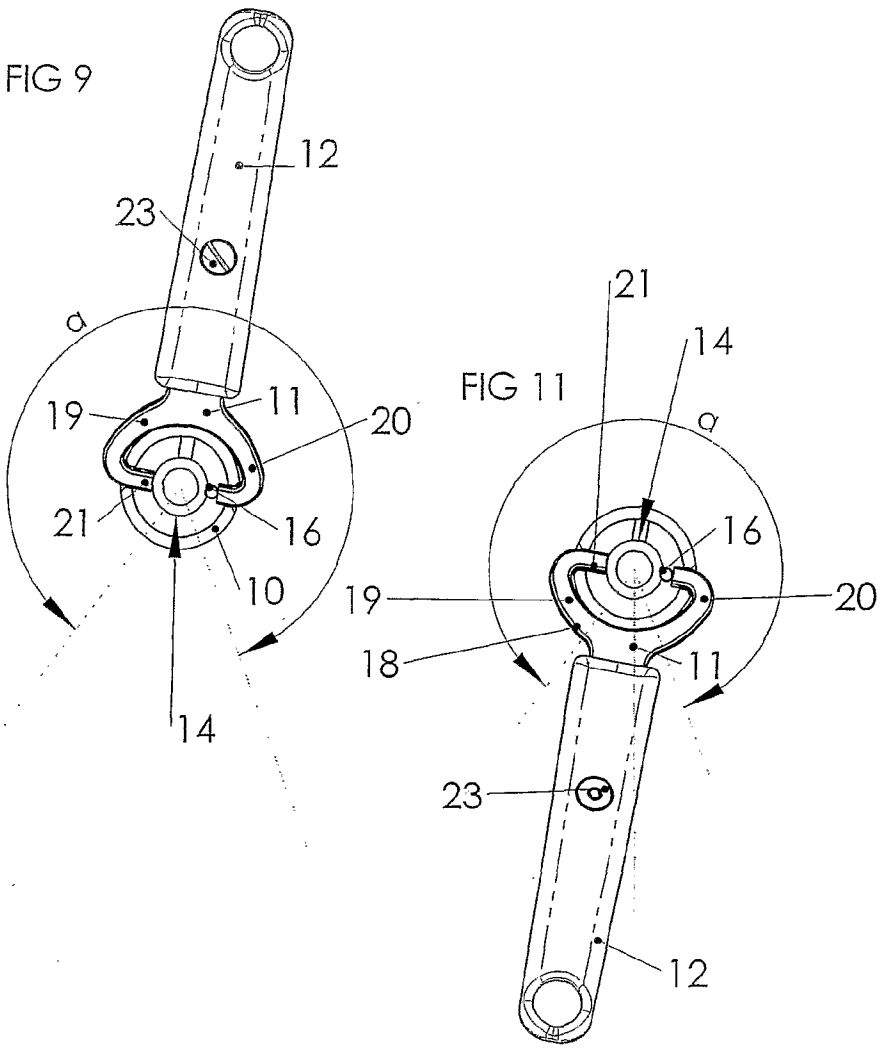
FIG 9
FIG 11
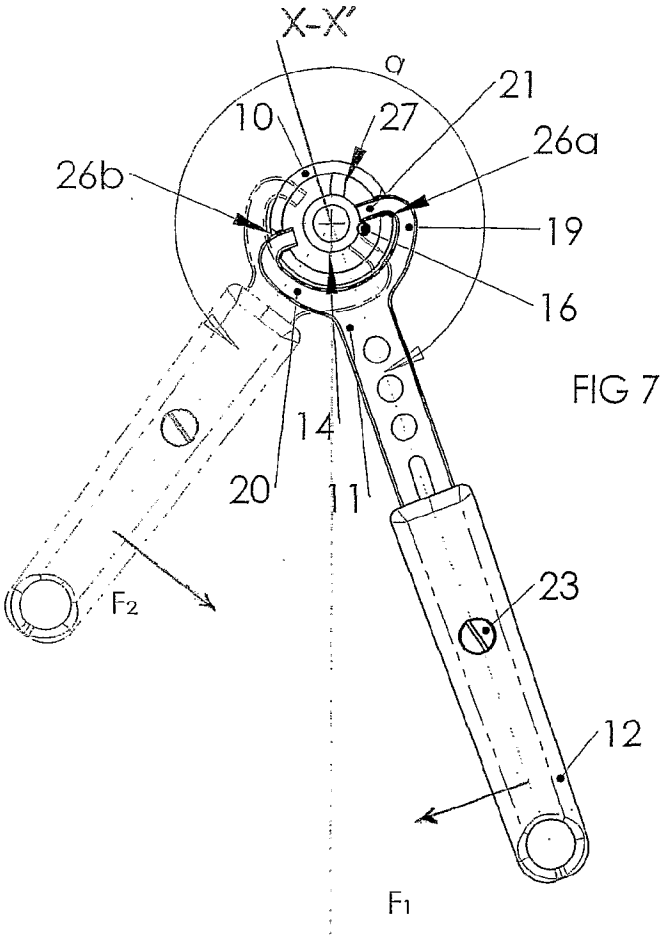
FIG 7

TIGHTENING DEVICE WITH SWIVELLING HANDLING ARM AND APPLIANCE INCLUDING SUCH A DEVICE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention concerns a tightening device with a swiveling arm. It also deals with the equipment provided with this tightening device, for example portable tools, and in particular portable chain saws.

2. Description of Related Art Including Information Disclosed Under 37 CFR 1.97 and 37 CFR 1.98.

It is common to use a screw or a nut screwed on a threaded rod to obtain a tight grip between two parts. A part mounted by means of a screw-nut system presents the advantage of being removable. However, its disassembly and subsequent reassembly require the loosening of the nuts or the screws by means of an independent tool such as a wrench or a screwdriver, and then their re-tightening by this same tool. Now, one does not always have such a tool available, which may be lacking at the very moment when one needs to loosen and/or tighten nuts or screws.

Also, it happens frequently that a screwdriver or a wrench may slip off inadvertently from the head of the screw or from the nut during the operation. Therefore, the tightening and loosening of a nut or a screw make it sometimes necessary to know how to combine force and skill.

Portable chain saws are generally equipped with a screw-nut device to perform the tightening and blocking, in the desirable position, of the guide bar, to allow a tension adjustment of the chain or the installation of a new chain.

In such an application, one can see that the operator must always have within reach a specific tool for loosening or tightening the nut or the set screw, especially during use of the tool out of doors when one may have to perform tension adjustments of the chain saw.

To mitigate this constraint, one has proposed (DE-29909645 U1) a tightening device for the guide bar of a chain saw, by means of a screw-nut system according to which the nut of the system is permanently secured to a handling wrench which can be folded back against the tool housing, in a neutral position when not in use. According to this device, a rotary ring is placed under the head of the nut and the wrench is fastened with a capability of swiveling on this ring, around an axis that is perpendicular to the axis of the nut and in an offset manner in relation to the latter. On the other hand, two radial grooves have been made on the head of the nut, while the wrench is provided with a tooth which, depending on the swiveled position of said wrench, can mesh with one of said grooves to allow the rotary actuation of the nut in one direction or the other, or be disengaged from said grooves to let the wrench rotate freely around the nut.

This device requires, prior to the rotary movement of the nut or the placement of the wrench in the storage position, an obligatory engaging or disengaging operation, whatever the case may be, or an operation which may not be immediately understood by the users.

The aim of the invention is at least to propose a solution to the problems deriving from the various constraints exposed above.

BRIEF SUMMARY OF THE INVENTION

According to the invention, this aim has been achieved thanks to a tightening device of the screw-nut kind, comprising a tightening member that can be rotated and a driving wrench of this tightening member equipped with a handling arm. This wrench and tightening member are joined by a connecting device contrived in such a way that the wrench can swivel in relation to the tightening member around a swivel axis that is perpendicular to the screwing axis of said tightening member, so as to allow its placement in a rest position essentially perpendicular to said screwing axis, and can rotate the tightening member around the screwing axis in the direction of tightening or of loosening, or turn freely in relation to the tightening member, around said screwing axis, over a range of angular clearance of at least 170°, after immobilization of said tightening member, at the end of the tightening operation.

Thanks to the invention, operating the tightening device does not require the use of any outside tool to tighten or loosen the tightening member (screw or nut) of said device. The wrench connected to the tightening member lets the latter rotate, even while it can be placed in a determined rest position without modifying the tight fit obtained, for example in a folded back position against the housing of the equipment so as not to interfere with the utilization of the latter. Furthermore, this operation is very simple and fast.

According to an advantageous mode of execution, the rotary tightening member of the screw-nut system joined to the handling wrench is constituted by the nut of said system.

Advantageously, the tightening member and the wrench for rotating the connecting device are equipped, respectively, with means coming into contact with each other during rotation of the wrench, on the one hand, in the screwing direction of the tightening member when the wrench is at a first end of the range of angular clearance, as well as, on the other hand, in the unscrewing direction of the tightening member when the wrench is at a second end of the range of angular clearance.

According to a preferred mode of execution, the connecting means between the wrench for rotating and the tightening member include:

- a ring-shaped groove made in the outside cylindrical surface of the rotating tightening member and in the base of which is seated a catch stop which is oriented parallel to the screwing axis of said rotating tightening member;
- a tubular rotating cap in which is housed the body of said tightening member and which features two diametrically opposed holes opening into the ring-shaped groove of said tightening member, and
- a layout of the head of the wrench for rotating according to which said head is produced in the form of a twopronged fork. The ends of these prongs are curved back or shaped in the direction of each other and being able to rotate in the diametrically opposed holes of the rotating cap, one at least of these bent back ends being dimensioned so it can extend through said groove and come into contact with the catch stop of the rotating tightening member.

According to another advantageous characteristic, the curved end of the second prong of the drive fork is dimensioned so as not to come into contact with the catch stop of the tightening member when the wrench is swiveled around the screwing axis, in relation to the tightening member.

Another advantageous characteristic of the tightening device can be that said connecting device produces a non-removable connection between the wrench and the tightening member.

Advantageously, the non-removable connection between the wrench and the tightening member is obtained by plastic deformation of said prongs towards each other, so as to engage these prongs in the holes of the cap.

Preferably, said connecting device forms a removable connection between the wrench and the tightening member, at least in the absence of a tightening operation by this tightening member.

Preferably, the tightening member features a notch for lateral access to said ring-shaped groove, for the passage of one of said prongs to this ring-shaped groove, one of said holes in the cap having the shape of a slot with one open end for the passage of one of said prongs.

Advantageously, the wrench has a handling arm equipped with an extension with which the handling arm forms a telescopic sleeve of variable length, said extension being movable along the handling arm between a retracted position and an extended position of the telescopic sleeve.

Preferably, one part at least of the handling arm is made of magnetic material.

The subject of the invention is also equipment characterized in that it features a tightening member as defined above.

According to an advantageous application, this equipment is constituted by a chain saw with an endless cutting chain as well as a guide bar for this chain, and where a blocking device of this guide bar includes said tightening member.

Advantageously, the equipment comprises a storage area for the sleeve of the tightening device, in a predetermined angular position, around the screwing axis.

Preferably, the equipment is provided with a magnet to retain the sleeve in the stored position in the storage area.

BRIEF DESCRIPTION OF THE SEVERAL VIEWS OF THE DRAWINGS

The invention will be clearly understood when reading the description below, given solely as an example and made with reference to the attached drawings.

FIG. 7 is a top plan view, with a partial break-away view, of the tightening device of FIGS. 2 to 5, illustrating a wrench position considered to be arbitrarily as a final stage of a tightening by means of the tightening device of FIGS. 2 to 5. The representation in thin broken lines illustrates a position of the wrench while loosening.

FIG. 9 is a top plan view analogous to FIG. 7, illustrating the pivoting of the wrench in a position where it can be swiveled to its retracted rest position.

FIG. 11 is a top plan view analogous to FIG. 9, showing the swiveling of the wrench in the rest position.

DETAILED DESCRIPTION OF THE INVENTION

Reference is made to said drawings to describe an advantageous although by no means limiting mode of execution of the tightening device according to the invention.

Although particularly advantageous application of the invention for the equipment of chain saws is described, the claimed tightening device can also be applied to other tools or machines in which frequent tightening adjustments need to be made, especially for equipment used out of doors.

Figure 1:
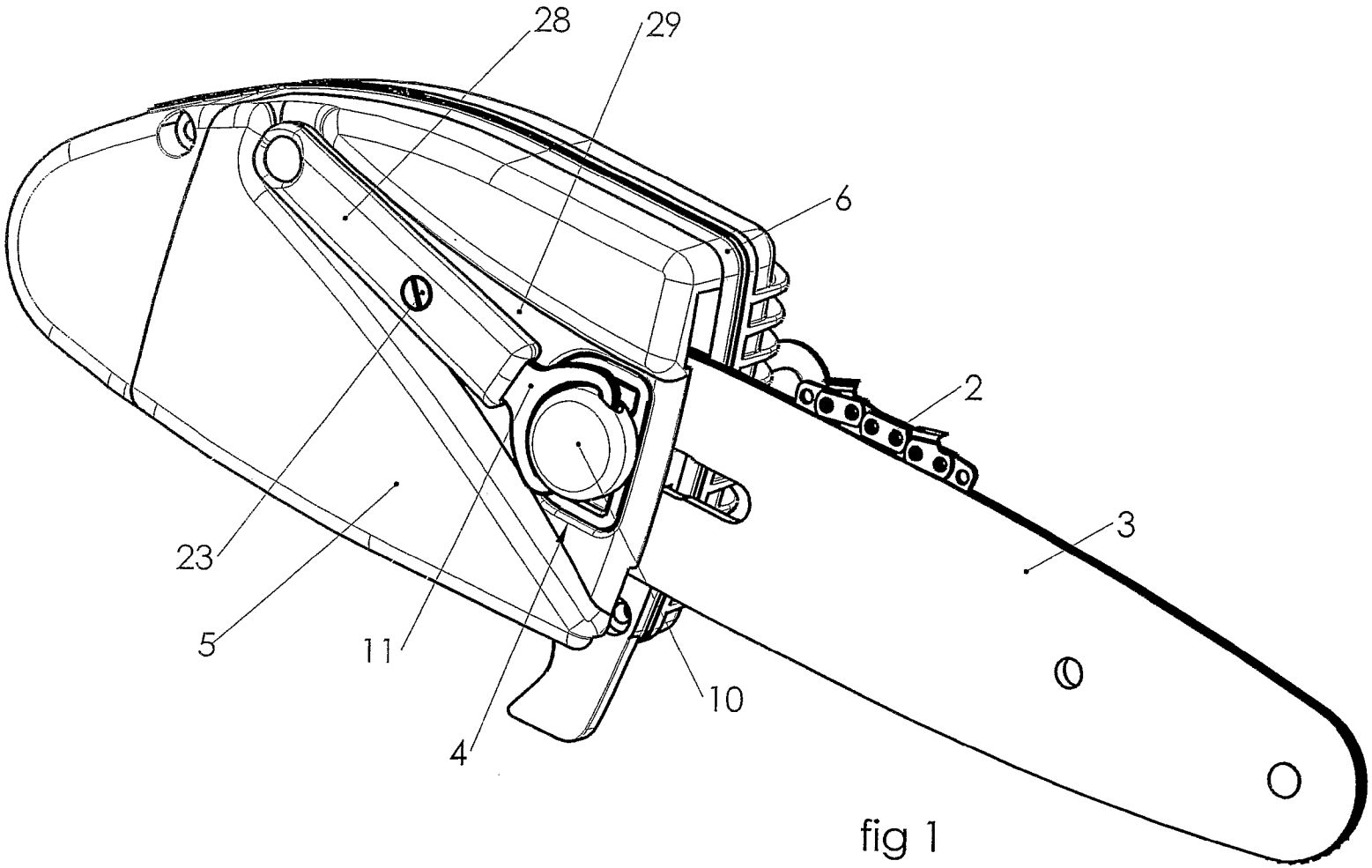
FIG. 1 is a perspective view of a chain saw in accordance with invention.

FIG. 1 shows a portable chain saw 1, which features a partially illustrated cutting chain 2 and a guide bar 3, which maintains and supports this chain 2. A tightening device 4, designated in its assembly by the reference 4 in FIG. 1, tightens this guide bar 3 and a protective housing 5 between a jaw 5A and an assembly body 6.

Figure 2:
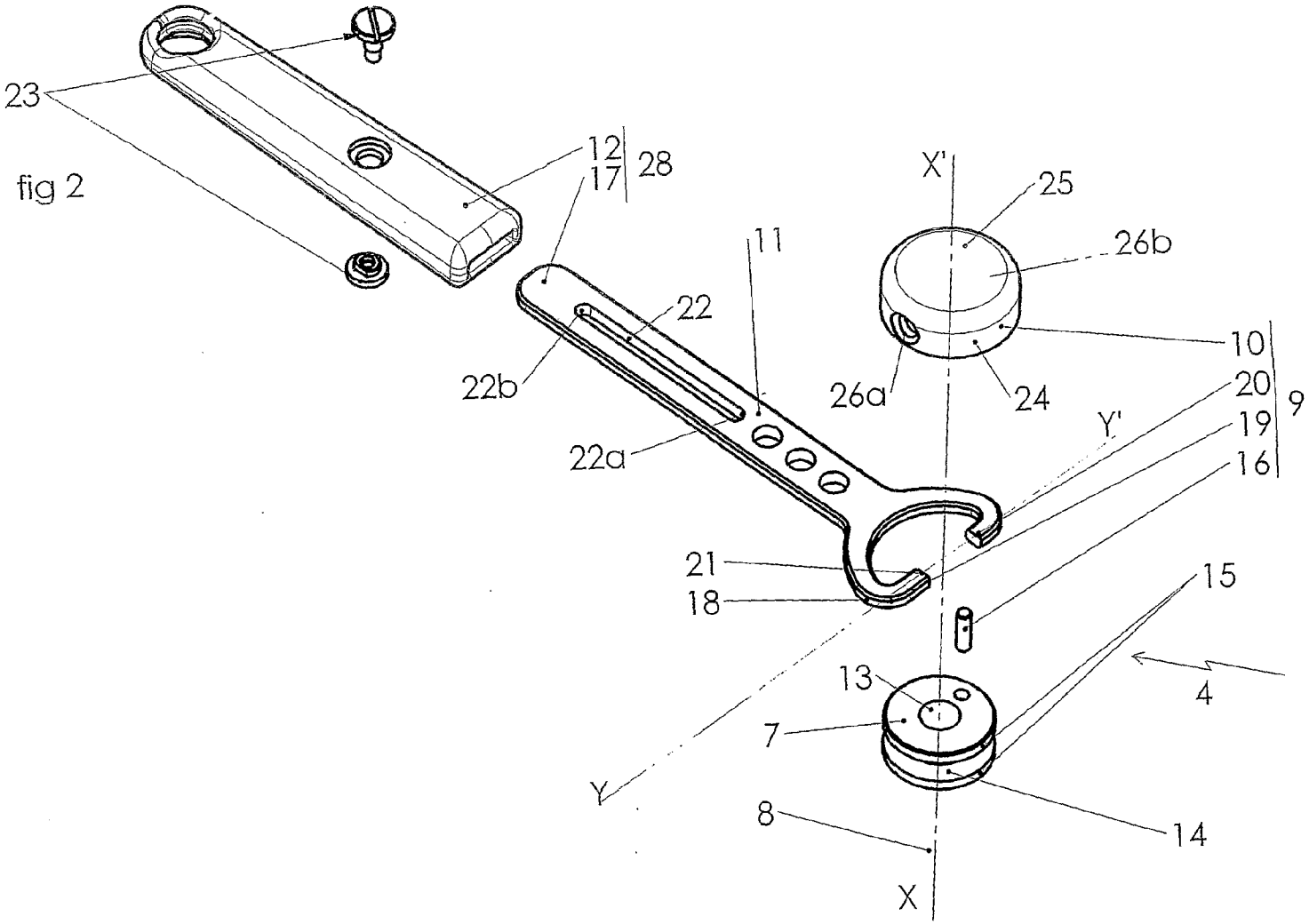
FIG. 2 is an exploded perspective view of a tightening device on the chain saw of FIG. 1, according to the invention.

FIG. 2 shows the tightening device 4, which includes a nut 7 intended to be screwed on a threaded shank 8, for example constituted by the threaded shank of a screw. This tightening device also includes a handling wrench 11 and a connecting device designated in its entirety by the reference 9 allowing joining the nut 7 to said handling wrench 11.

The nut 7 has a tapped hole 13 with the axis X-X' which is the screwing axis of this nut, which is to say the axis around which the nut 7 rotates, while it is being tightened and loosened. The nut 7 is provided with a ring-shaped and lateral groove 14, on its peripheral surface 15.

This peripheral surface 15 is cylindrical and has a circular section which is centered on the axis X-X'.

The nut 7 is provided with a pin 16 which traverses the lateral groove 14 all the way through.

The nut 7 is capped with a rotary encompassing tubular cap 10 featuring two diametrically opposed holes 26*a*, 26*b* going into the peripheral groove 14 of said nut.

The wrench 11 is flat and can advantageously be made from a steel blank. It comprises an arm 17, which is extended by a coupling head 18 to the nut 7. The head 18 presents the form of a fork with two prongs 19 and 20 and which bend inward towards each other. One of these prongs (prong 19) is longer than the other (prong 20) and its end portion forms a finger 21 which strikes against the pin 16, on one side or the other of the latter, depending on the rotary direction of the wrench.

The cap 10 has a cylindrical skirt 24, which is closed by an end wall 25. Two through-bores 26*a* and 26*b* for the passage of the prongs 19 and 20 are made in the skirt 24, opposite each other. One of the holes (hole 26*a*) can be circular and laterally closed.

According to one mode of execution, the second hole (hole 26*b*) presents the shape of a slot with one end being in the axis of hole 26*a* and the other end going into the edge of the cap 10 on the backside of the latter.

The terminal portions of the prongs 19 and 20 are co-axial and engaged in the holes 26*a* and 26*b* so as to form together a discontinued swiveling shaft of the wrench 11 on the cap 10. The swivel axis Y-Y' of this wrench 11 is perpendicular to the screwing axis X-X', said axes Y-Y' and X-X' crossing each other.

Figure 3:
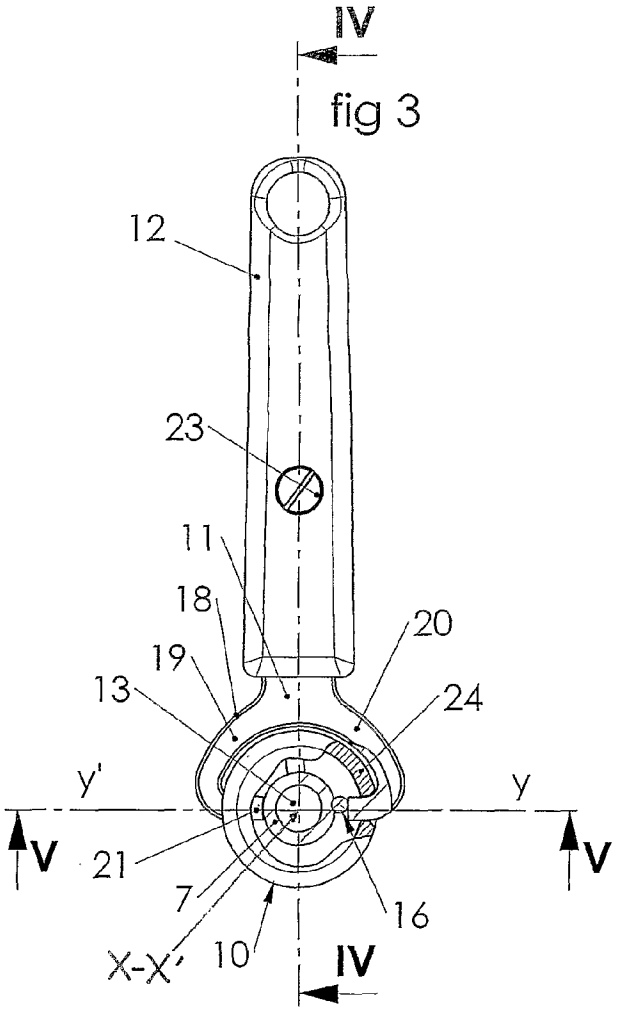
FIG. 3 is a top plan view with break-away, of the tightening device of FIG. 2.
Figure 4:
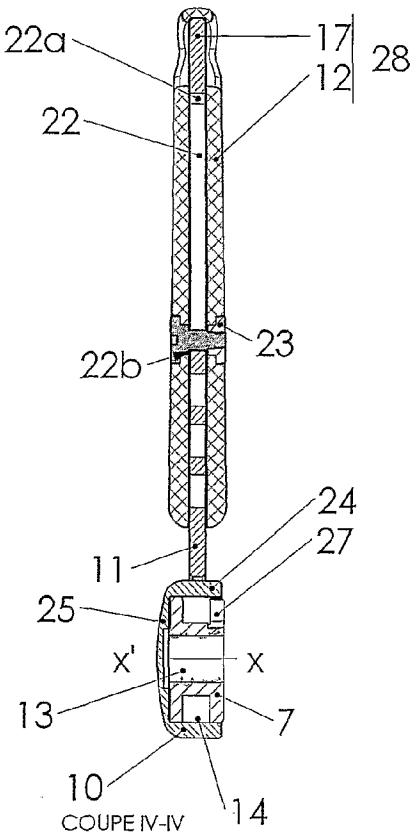
FIG. 4 is a sectional view along the line IV-IV of FIG. 3.
Figure 5:
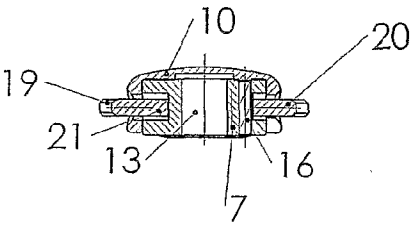
FIG. 5 is a sectional view along the line V-V of FIG. 3.

As one can see on FIGS. 3 to 5, the cap 10 is mounted in rotation on the nut 7 so that its axis of rotation coincides with the screwing axis X-X'. The prongs 19 and 20 penetrate into the peripheral groove 14 and thereby retain the wrench 11 and the cap 10 on the nut 7. Thereby they present the advantage of fulfilling a second function, their first function stated above being to form a swiveling assembly shaft.

In that respect, one notes that the prong 19, by means of its end 21, also fulfills a function of rotary catch of the nut 7. The sum of functions fulfilled by the prongs 19 and 20 contributes to an advantageous simplification of the tightening device 4 and improves it compactness.

A notch 27 is made laterally in the rear wall defining the groove 14 of the nut 7, this notch fitting into said groove.

Figure 6:
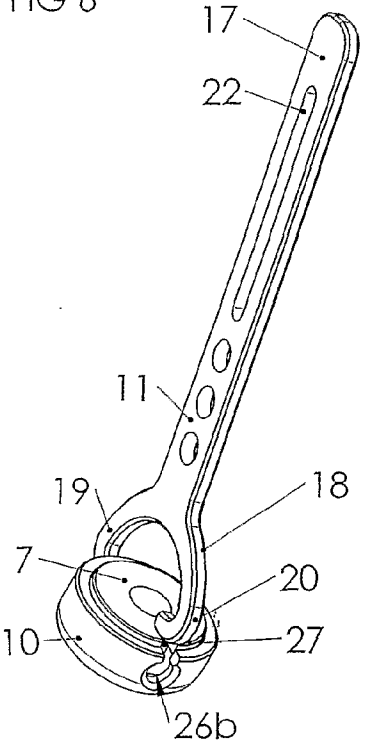
FIG. 6 is a perspective view of the tightening device shown in FIGS. 2 to 5, shown in its extension in the shape of a handle, illustrating a stage of assembly of the elements of said device.

To assemble the components of the connecting device, screw 7 is placed in the cap 10. Then the prong 19 is inserted in the hole 26*a* and the groove 14 of the nut. Finally, the other prong is slid towards to base of the slot 26*b*, while at the same time this prong 20 is engaged in the peripheral groove 14, by making it pass in the notch 27 (FIG. 6). This mode of assembly makes it possible to obtain a removable connection between the wrench 11 and the nut 7.

According to another mode of execution, the nut 7 can be without the notch 27, whereas the hole 26*b* can present the same circular form as the hole 26*a*. If this is the case, one can insert the prongs 19 and 20 in the hole 26*a*, the hole 26*b*, and the groove 14 by distorting them plastically towards each other. In this case, one obtains a non-removable connection between the wrench and the tightening member.

According to an advantageous mode of production, the handling arm of the wrench has an adjustable length. In this case, this handling arm consists of two telescopically assembled elements, namely an arm 17 equipped with the coupling head 18 on which a sliding extension 12 has been mounted.

This extension constitutes a handle, which can be produced in any convenient rigid manner, for example of plastic material. The internal arm 17 is equipped with a longitudinal slot 22 into which passes the shank of a bolt 23. This bolt 23 and the stop 22*a* form complementary retaining means of the handle 12 on the arm 17.

In contrast to the prong 19, the prong 20 can pass beyond the location of the pin 16 without attaching thereto, as one can see in FIG. 3.

The wrench 11 can rotate freely in relation to the nut 7, over a range of angular clearance referenced as α in FIG. 7. At one end of this range or clearance angle α, the finger 21 comes to strike against the pin 16 and thus couples the wrench 11 to the nut 7 in the direction of a screwing F1 of this nut 7, which is the case of the finger 21 shown in a solid line in FIG. 7. At the other end of the range or clearance angle α, the finger 21 also comes to strike against an opposite surface of the pin 16 and thus couples the wrench 11 to the nut 7, but in the direction of an unscrewing F2 of this nut 7, which is the case of the finger 21 of the wrench 11 in the thin broken line in FIG. 7. The pin 16 thus forms a double stop for the finger 21.

In the example shown, the range of angular clearance α extends over more than 340°, which is advantageous. It can however be less extended. But preferably, the range or angle of angular clearance α is at least 170°.

The handle 12 forms an extension in this sense that it can slide longitudinally on the arm 17. In other words, the arm 17 and the handle 12 form together a telescopic sleeve 28 which is shown in retracted position in FIG. 4 and which is shown in extension in FIG. 6.

Figure 10:
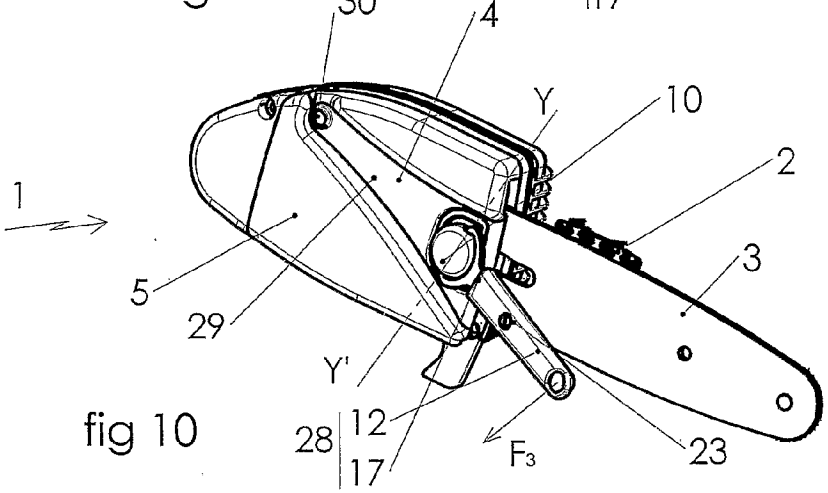
FIG. 10 is a perspective view of a chain saw, showing the wrench in a swiveling position corresponding to FIG. 9.

The housing 5 of the tool is laterally provided with a recess 29 to receive the handling arm 17 of the wrench or the telescopic sleeve 28 of the latter in retracted position. A retainer allows maintaining the handling arm 17 or the telescopic sleeve 28 of the wrench in the retracted position, against the housing 5 of the tool. For instance, in the base of the recess 29, a magnet is placed which retains the handling arm 17 or the sleeve 28 in the retracted resting position, this magnet being visible and designated by the reference 30 in FIGS. 8 and 10.

To tighten the nut 7, the wrench 11 is turned in the direction F1 around the screwing axis X-X' (FIG. 7) so that its finger 21 comes into contact with the pin 16, then turns the nut 7 through the intermediary of said pin 16.

Figure 8:
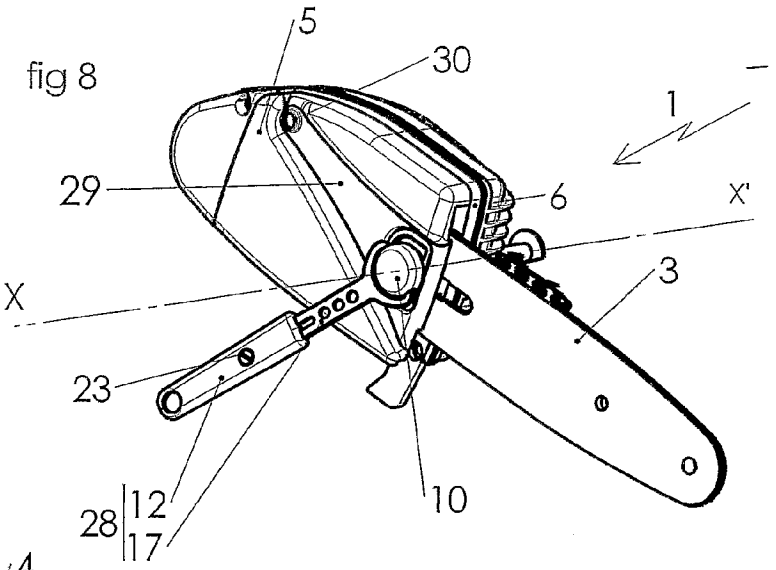
FIG. 8 is a perspective view analogous to FIG. 1, illustrating the same final stage of tightening as FIG. 7.

On FIGS. 7 and 8, it is assumed that the wrench 11 is in a position corresponding to the moment when the proper tightening force has just been obtained. It is then practical to retract the sleeve 28 into the recess 29 which is done without any difficulty when the angular position of this recess 29 around the axis X-X' is within the range of angular clearance a, at the end of the tightening of the nut 7. In effect, the wrench 11 can rotate freely, with the tightening member 7 remaining blocked in the blocked position corresponding to the desired tightening.

Figure 12:
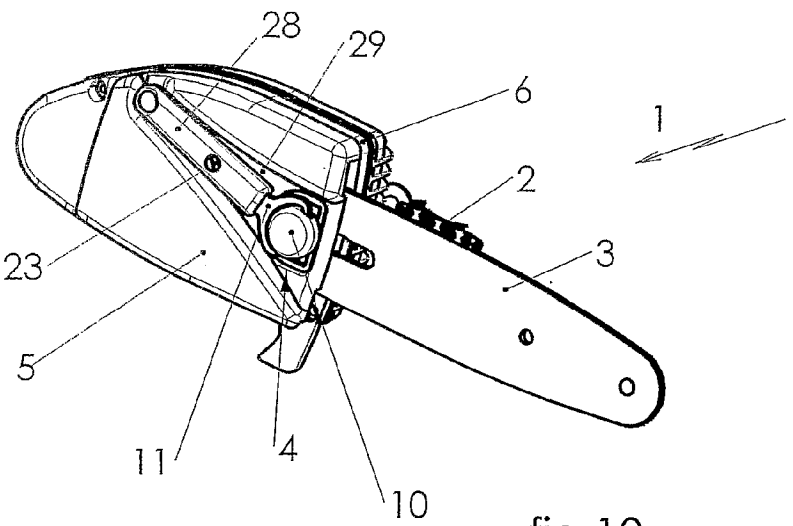
FIG. 12 is a perspective view of the chain saw shown in FIGS. 8 and 10, showing the handling arm of the wrench in the retracted position against the housing of said chain saw.

In the example shown in FIG. 8, the angular position of the recess 29 around the axis X-X' is outside the range of angular clearance α, after tightening of the nut 7. The storage of the sleeve 28 includes thus a first stage which consists of putting this sleeve 28 in the position shown in FIG. 10, by making it pivot around the axis X-X', after having retracted it. On this FIG. 10, the retracted sleeve 28 is opposite the recess 29 in relation to the axis X-X'. It is then swiveled around the axis Y-Y', in the direction of the arrow F3, in order to embed it in the recess 29, after which the sleeve 28 is as shown in FIGS. 1 and 12. In these figures, the sleeve 28 of the wrench is stored in the recess 29, where it is retained by the magnet 30 which attracts a magnetic part of this sleeve 28, namely its handling arm 17. Other means of retention of the handling arm of the wrench in the retracted position may be provided.

When the nut 7 is tightened against the jaw 5A, the latter laterally closes the notch 27, as well as the hole 26*b*, so that the wrench 11 and the cap 10 can no longer be separated from the nut 7.

The invention does not limit itself to the mode of production described above. In particular, the mobile tightening member in rotation can be constituted by a screw, in which case the connecting device 9, which has been described is to be found at the head of this screw.

I claim:

1. A tightening apparatus comprising:

a tightening member having a screwing axis about which said tightening member can rotate; and a wrench suitable for rotating said tightening member, said wrench having a handling arm, said wrench being connected to said tightening member such that said wrench can swivel about a swivel axis in relation to said tightening member, said swivel axis being perpendicular to said screwing axis, said wrench causing said tightening member to rotate around said screwing axis for at least 170° for tightening the tightening member, said tightening member movable to a rest position substantially perpendicular to said screwing axis after the tightening, said tightening member having a pin and said handling wrench having a prong that contact each other in the tightening direction when said wrench is at one end of a range of motion and also in a loosening direction when said wrench is at another end of the range of motion.

2. The tightening apparatus of claim 1, said tightening member being a nut.

3. The tightening apparatus of claim 1, said tightening member having a ring-shaped groove formed on a cylindrical external surface, said tightening member having a catch formed therein so as to be exposed at a base of said ring-shaped groove, said catch extending in parallel relation to the screwing axis of said tightening member, the tightening apparatus further comprising:

a tubular cap positioned over said tightening member, said tubular cap having a pair of diametrically-opposed holes opening to said ring-shaped groove of said tightening member, said wrench head having a fork shape with said prong of one side of said head and another prong at another side of said head, the prongs facing each other and received respectively in said pair of diametrically-opposed holes of said tubular cap.

4. The tightening apparatus of claim 3, said another prong being dimensioned so as not to come into contact with said pin during the movement of said wrench around the screwing axis.

5. The tightening apparatus of claim 3, said tightening member having a notch opening laterally to said ring-shaped groove so as to allow a passage of one of the prongs toward said ring-shaped groove, one of said pair of diametrically-opposed holes of said cap having a slot extending thereto.

6. The tightening apparatus of claim 1, said pin forming a non-removable connection between said wrench and said tightening member.

7. The tightening apparatus of claim 1, said handling arm of said wrench having a telescopic sleeve extending thereover, said telescopic sleeve forming a extension of said handling arm, said extension being movable along said handling arm between a retracted position and an extended position.

8. The tightening apparatus of claim 7, said wrench having a stop therein for retaining said telescopic sleeve on said handling arm.

9. The tightening apparatus of claim 1, said handling arm formed at least partially of a magnetic material.

10. The tightening apparatus of claim 1, further comprising:

a chain saw having an endless cutting chain thereon, said chain saw having a guide bar over which said endless chain extends, said tightening member and said wrench being cooperative with said guide bar so as to tighten said guide bar.

11. The tightening apparatus of claim 10, said chain saw having a body with a storage area formed in a surface thereof, said handling arm of said wrench receivable in said storage area.

12. The tightening apparatus of claim 11, further comprising:

a magnet affixed to at least one of said storage area and said handling arm so as to magnetically retain said handling arm in said storage area.

* * * * *